US007298098B2

(12) United States Patent
Wang

(10) Patent No.: US 7,298,098 B2
(45) Date of Patent: Nov. 20, 2007

(54) INTELLECTUAL LAMP UNIT ABLE TO BE INSTALLED ON A CONVENTIONAL LAMP SOCKET CONTROLLED BY A WALL SWITCH

(75) Inventor: Robert Wang, Taoyuan (TW)

(73) Assignee: Ceramate Technical Co., Ltd., Taoyuan (TW)

( * ) Notice: Subject to any disclaimer, the term of this patent is extended or adjusted under 35 U.S.C. 154(b) by 116 days.

(21) Appl. No.: 11/327,476

(22) Filed: Jan. 9, 2006

(65) Prior Publication Data

US 2007/0159111 A1 Jul. 12, 2007

(51) Int. Cl.
*G05F 1/00* (2006.01)

(52) U.S. Cl. ..... 315/307; 315/291; 315/75; 315/74; 315/247; 362/378; 362/251; 362/194; 362/247

(58) Field of Classification Search ..... 315/307, 315/291, 297, 50–59, 247, 246; 362/194, 362/195, 247–251, 377, 378
See application file for complete search history.

(56) References Cited

U.S. PATENT DOCUMENTS 6,168,282 B1 * 1/2001 Chien ..... 362/84
2005/0001563 A1 * 1/2005 Logan ..... 315/291

* cited by examiner

*Primary Examiner*—Tuyet Vo
(74) *Attorney, Agent, or Firm*—Ming Chow; Sinorica, LLC

(57) ABSTRACT

An intellectual lamp unit able to be installed on a conventional lamp socket controlled by a wall switch includes a bypass connected in parallel with a wall switch and provided with a resistance or a diode for producing potential difference or power phase difference when the wall switch is turned off. An intellectual lamp to be installed on a conventional lamp socket consists of a lamp main body disposed therein with a power processing circuit, a detecting switch, a charging circuit, a charging battery, a driving circuit, a microprocessor and a lamplight source. When the wall switch is turned on or off under the condition of normal power supply, the lamplight source can be controlled to produce or extinguish lighting, and during blackout, the lamplight source can be started to produce emergency lighting immediately, supplied with power by the charging battery.

10 Claims, 3 Drawing Sheets

INTELLECTUAL LAMP UNIT ABLE TO BE INSTALLED ON A CONVENTIONAL LAMP SOCKET CONTROLLED BY A WALL SWITCH

BACKGROUND OF THE INVENTION

1. Field of the Invention

This invention relates to an intellectual lamp unit, particularly to one able to be installed on a conventional lamp socket controlled by a wall switch.

2. Description of the Prior Art

Conventional lamps controlled by wall switches are widely used for lighting a home, an office or an assembly hall.

However, the conventional lamps are only used for lighting without other functions; therefore, during electric interrupting, they cannot carry out lighting and at this time, people have to rely upon emergency lamps for lighting, but it costs a lot to purchase and install emergency lamps. In addition, emergency lamps cannot function to produce lighting ordinarily; therefore, once disasters should occur and cause electric stoppage or a fire, with no emergency lighting equipment ready for use, danger might be likely to result.

SUMMARY OF THE INVENTION

The objective of the invention is to offer an intellectual lamp unit able to be installed on a conventional lamp socket controlled by a wall switch, which includes a bypass connected in parallel with a wall switch and provided with a resistance or a diode for producing potential difference or power phase difference when the wall switch is turned off. An intellectual lamp to be installed on a conventional lamp socket consists of a lamp main body disposed therein with a power processing circuit, a detecting switch, a charging circuit, a charging battery, a driving circuit, a microprocessor and a lamplight source. When the wall switch is turned on or off under the condition of normal power supply, the lamplight source of the intellectual lamp can be controlled to produce or extinguish lighting, and when blackout occurs, the lamplight source can be started immediately and supplied with power by the charging battery for producing emergency lighting whether the wall switch is turned on or off.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
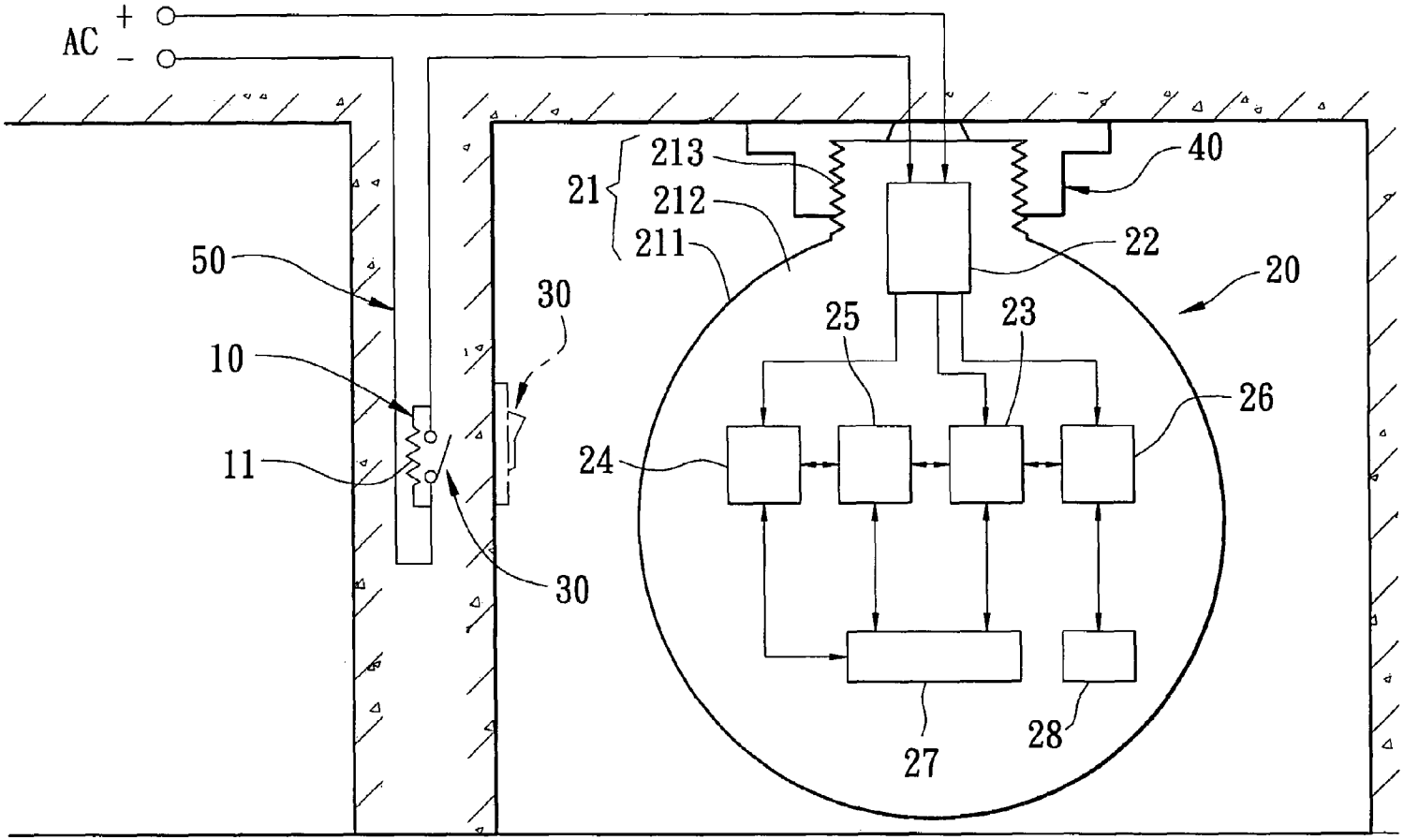
FIG. 1 is a block diagram of a first preferred embodiment of the inner structure and the circuit disposition of an intellectual lamp in the present invention.

A first preferred embodiment of an intellectual lamp unit able to be installed on a conventional lamp socket controlled by a wall switch in the present invention, as shown in FIG. 1, includes a bypass 10 and an intellectual lamp 20. The intelligent lamp unit can be installed on a conventional lamp socket 40 controlled by a wall switch 30 that is connected with a main power source 50 for supplying AC to the wall switch 30.

The intelligent lamp 20 consists of a lamp main body 21, a power processing circuit 22, a detecting switch 23, a charging circuit 24, a charging battery 25, a driving circuit 26, a microprocessor 27 and a lamplight source 28.

Figure 3:
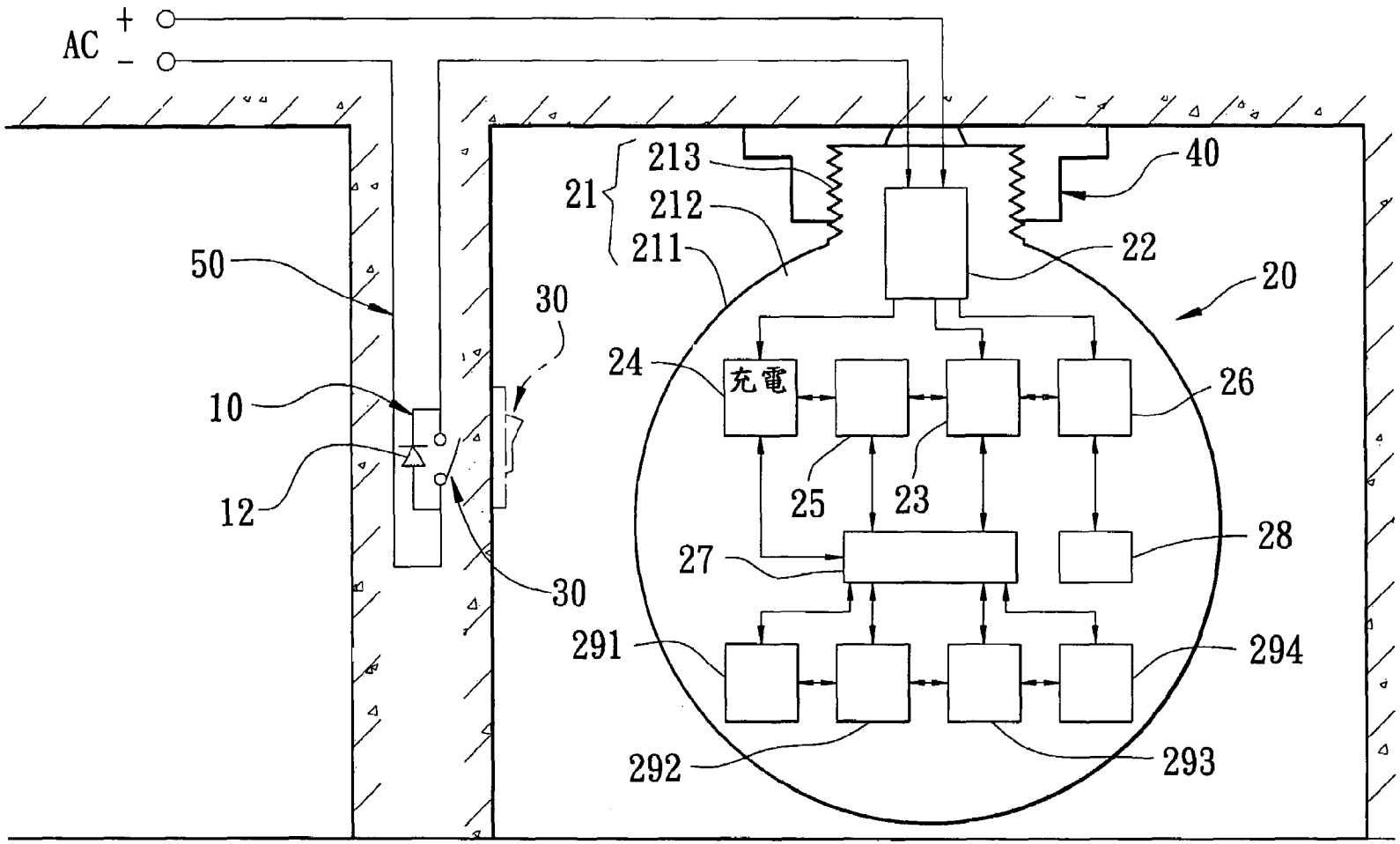
FIG. 3 is a block diagram of the second preferred embodiment of the inner structure of an intellectual lamp, having a bypass connected in parallel in another mode in the present invention.

The bypass 10 is connected in parallel with the wall switch 30 and provided thereon with an electronic element, such as a resistance 11 or a diode 12, as shown in FIG. 3. Thus, when the wall switch 30 is turned ON, the main power source 50 will transmit AC with a normal voltage to the lamp socket 40 through the wall switch 30. On the contrary, when the wall switch 30 is turned OFF, it will form an open circuit to let the power source 50 pass through the bypass 10 connected in parallel with the wall switch 30. When the bypass 10, through which the power source 50 passes, is provided with the resistance 11, the power source 50 will produce a reduced voltage potential difference, and when the bypass 10 is provided with a diode 12, the power source 50 will produce a power phase difference and transmit AC with a reduced voltage or a phase-difference to the lamp socket 40, but during blackout, the power source 50 cannot supply the lamp socket 40 with AC.

The lamp main body 21 includes a transparent shell 211 having its interior formed with an accommodating space 212 and having one end connected with a lamp connector 213 to be threadably combined and electrically connected with the conventional lamp socket 40 so that the lamp connector 213 can receive a normal-voltage alternating current supplied through the wall switch 30 and the lamp socket 40, or receive AC with an abnormal voltage supplied through the bypass 10 and the lamp socket 40. The AC with an abnormal voltage means AC with a reduced voltage or with a phase-difference produced after AC is transmitted by the power source 50 and passes through the bypass 10.

The power processing circuit 22 is installed in the accommodating space 212 of the lamp main body 21 and connected with the lamp connector 213 of the lamp main body 21 for receiving AC with a normal voltage or an abnormal-voltage supplied by the lamp connector 213 and rectifying it into DC with a normal voltage or an abnormal voltage.

The detecting switch 23 is positioned in the accommodating space 212 of the lamp main body 21 and connected with the power processing circuit 22 for detecting DC supplied by the power processing circuit 22. When DC is detected to have a normal voltage or an abnormal voltage, the detecting switch 23 will transmit outward a normal signal, letting the detecting switch 23 form an open circuit. On the other hand, when the voltage value of DC is detected to be zero, the detecting switch 23 will transmit outward a blackout signal, letting the detecting switch 23 electrically turned ON.

The charging circuit 24 is disposed in the accommodating space 212 of the lamp main body 21 and connected with the power processing circuit 22 for receiving DC supplied by the power processing circuit 22 and supplying DC needed for charging.

The charging battery 25 is received in the accommodating space 212 of the lamp main body 21 and connected with the charging circuit 24 for receiving DC supplied by the charging circuit 24 for carrying out charging. The charging battery 25 is also connected with the detecting switch 23 so that when the detecting switch 23 is electrically connected, it will supply the charging battery 25 with DC.

The driving circuit 26 is assembled in the accommodating space 212 of the lamp main body 21 and connected with both the power processing circuit 22 and the detecting switch 23 so that the driving circuit 26 can receive DC with a normal voltage or an abnormal voltage supplied by the power processing circuit 22 or receive DC supplied by the charging battery 25 through the detecting switch 23.

The microprocessor 27 is connected with the charging circuit 24 and the charging battery 25 as well as the detecting switch 23. On receiving a normal signal transmitted by the detecting switch 23, the microprocessor 27 will command the charging circuit 24 to charge the charging battery 25. On the other hand, when receiving a blackout signal transmitted by the detecting switch 23, the microprocessor 27 will command the charging battery 25 to supply the driving circuit 26 with DC through the detecting switch 23.

The lamplight source 28 is set in the accommodating space 212 of the lamp main body 21 and connected with the driving circuit 26. On receiving DC with a normal voltage supplied by the power processing circuit 22 through the driving circuit 26, the lamplight source 28 can be started to produce lighting. Further, the lamplight source 28 can automatically start to produce lighting when receiving DC supplied by the charging battery 25 through the detecting switch 23 and the driving circuit 26. Furthermore, the lamplight source 28 can be turned off to extinguish lighting when receiving DC with an abnormal voltage supplied by the power processing circuit 22 through the driving circuit 26.

In addition, the power processing circuit 22, the detecting switch 23, the charging circuit 24, the charging battery 25, the driving circuit 26 and the micro-processor 27 of the intellectual lamp 20 can be disposed on a circuit board (not shown) to be positioned in the accommodating space 212 of the lamp main body 21.

Figure 2:
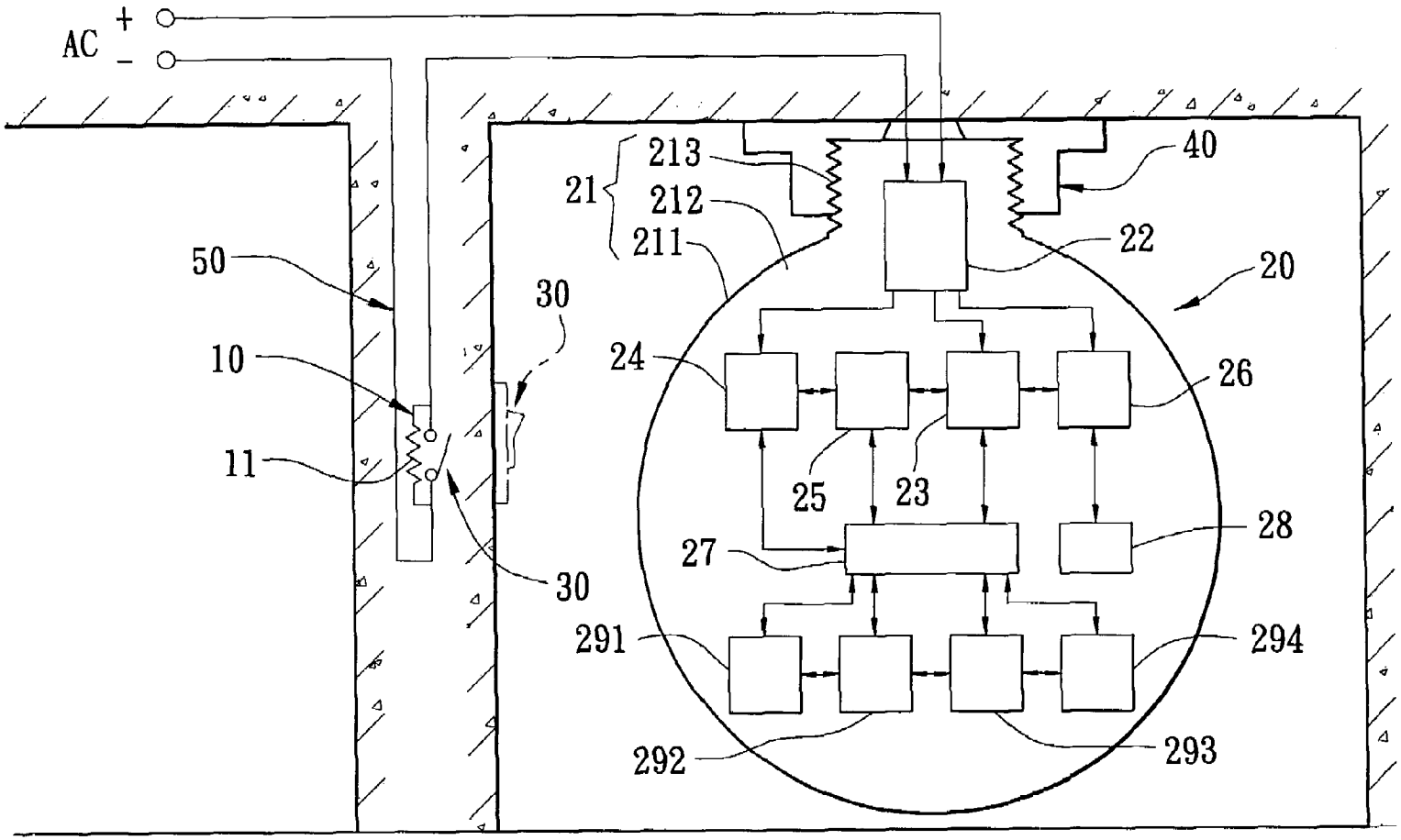
FIG. 2 is a block diagram of a second preferred embodiment of the inner structure of an intellectual lamp in the present invention.

A second preferred embodiment of an intellectual lamp unit able to be installed on a conventional lamp socket controlled by a wall switch in the present invention, as shown in FIG. 2, is to have the micro-processor 27 of the intellectual lamp 20 connected with a human body detector 291, an earthquake detector 292, a fire detector 293 and a warning indicator 294, or optionally connected with any one of them. The human body detector 291, the earthquake detector 292, the fire detector 293 and the warning indicator 294 are positioned at the outer side of the lamp main body 21 and could be installed on a ceiling or a wall so that when people pass by, or when an earthquake or a fire occurs, they can quickly detect or produce induction and give out warning.

In assembling, as shown in FIG. 1, firstly, select a conventional lamp socket 40 controlled by a wall switch 30 according to a user's requirement and then assemble the intellectual lamp 20 of this invention on the conventional lamp socket 40. Next, the bypass 10 provided with a resistance 11 is connected in parallel with the wall switch 30 to finish assembly of the intellectual lamp 20.

Different conditions of using the intellectual lamp 20 are described as follows.

1. Under the condition of normal power supply of the main power source:

(1-1). When the wall switch is turned ON or positioned at ON, the main power source 50 can supply the lamp socket 40 with AC with a normal-voltage through the wall switch 30 and then AC with the normal voltage is transmitted to the power processing circuit 22 through the lamp connector 213 of the lamp main body 21 and rectified into DC. After the detecting switch 23 detects DC with the normal voltage transmitted by the power processing circuit 22, it will form an open circuit and transmit a normal signal to the micro-processor 27, which then commands the charging circuit 24 to charge the charging battery 25. In addition, the power processing circuit 22 can simultaneously supply the driving circuit 26 with DC through the driving return circuit 26 for starting the lamplight source 28 to produce lighting. If the intellectual lamp 20 is provided with a fire or an earthquake detecting circuit 293 or 292, as shown in FIG. 2, the fire detector 293 or the earthquake 292 can immediately detect the occurrence of a fire or an earthquake and transmit a detected signal to the micro-processor 27, which then commands the warning indicator 294 to give out flickering light or sounds for warning.

(1-2). When the wall switch is turned OFF or positioned at OFF, it will form an open circuit and AC of the power source 50 will supply a reduced abnormal voltage for the lamp socket 40 through the bypass 10 connected in parallel with the wall switch 30. Simultaneously, AC with the reduced abnormal voltage is transmitted to the power processing circuit 22 through the lamp connector 213 of the lamp main body 21 and rectified into DC to let the detecting switch 23 detect DC with a reduced voltage and form an open circuit and then transmit a normal signal to the micro-processor 27, which then commands the charging circuit 24 to charge the charging battery 25. In addition, the power processing circuit 22 can simultaneously supply the driving circuit 26 with DC with a reduced abnormal voltage to let the driving circuit 26 turn off the lamplight source 28 to extinguish the lighting. If the intellectual lamp 20 of this invention is provided with a fire or an earthquake detecting circuit 293 or 292, as shown in FIG. 2, the fire detector 293 or the earthquake detector 292 can work normally to carry out detection for security.

2. Under the condition of blackout of the main power source owing to a fire or other natural disasters, such as typhoon, earthquake or twister:

(2-1). If the wall switch 30 is turned ON or positioned at ON and blackout occurs., the power source 50 cannot supply the lamp socket 40 with AC through the wall switch 30 or through the bypass 10; therefore, the detecting switch 23 impossible to detect a direct current will be in a turned-on condition and transmit a blackout signal to the micro-processor 27. Then, the micro-processor 27 will command the charging battery 25 to supply the driving circuit 26 with DC through the turned-on detecting switch 23 to let the driving circuit 26 automatically start the lamplight source 28 to give out emergency lighting at the instant of blackout, and after power recovers, they will regress to the original condition described above in the item (1-1). In addition, when the intellectual lamp 20 of this invention is provided with a fire or an earthquake detecting circuit 293 or 292, as shown in FIG. 2, the fire detector 293 or the earthquake detector 292 can be supplied with power by the charging battery 25 to work normally to carry out detection for security.

(2-2). If the wall switch 30 is turned OFF or positioned at OFF and blackout occurs, the power source 50 is unable to supply the lamp socket 40 with AC; therefore, the detecting switch 23 cannot detect DC and becomes turned on, transmitting a blackout signal to the micro-processor 7. Then, the microprocessor 27 will command the charging battery 25 to supply the driving circuit 26 with DC through the detecting switch 23 and synchronously the driving circuit 26 will automatically start the lamplight source 28 to give out emergency lighting at the instant of blackout. Additionally, when the power of the charging battery 25 is used up, the charging battery 25 can carry out charging automatically through the bypass 10 of the wall switch 30 when power recovers, thus enabling the charging battery 25 to always maintain sufficient power. If the intellectual lamp 20 of this invention is provided with a fire or an earthquake circuit 293 or 292, the fire detector 293 or the earthquake detector 292 will be supplied with power by the charging battery 25 to carry out detecting work normally for security.

As can be understood from the above description, the intellectual lamp 20 of this invention has the following advantages.

1. The intellectual lamp 20 can be directly installed on a conventional lamp socket 40 controlled by the wall switch 30; therefore, it is needless to dispose new circuit or alter the original circuit, only necessary to have the bypass 10 with the resistance 11 or the diode 12 connected in parallel with the wall switch 30, convenient and quick in assembly.

2. The intellectual lamp 20 can be used for lighting at ordinary times and in emergency, so it has more functions and is more useful than a conventional lamp or an emergency lamp, able to be installed on a conventional lamp socket 40 for use at any place where a wall switch 30 is provided for controlling the conventional lamp socket 40.

3. The intellectual lamp 20 can be optionally provided with a human body detector 291, an earthquake detector 292, a fire detector 293 and/or a warning indicator 294 for carrying out human body induction or disasters detection and giving out warning, able to insure security of the environment or people around and greatly elevate the additional value of products.

While the preferred embodiments of the invention have been described above, it will be recognized and understood that various modifications may be made therein and the appended claims are intended to cover all such modifications that may fall within the spirit and scope of the invention.

I claim:

1. An intellectual lamp unit installed on a conventional lamp socket controlled by a wall switch, said intellectual lamp unit comprising:

a bypass connected in parallel with a wall switch, said bypass provided with an electronic element, said electronic element functioning to convert AC passing therethrough into AC with an abnormal voltage to be transmitted to a lamp socket, a lamp main body formed with a transparent shell, said shell of said lamp main body having its interior formed with an accommodating space connected with a lamp connector, said lamp connector threadably assembled on and electrically connected with a conventional lamp socket, said lamp connector receiving AC with a normal voltage supplied through said wall switch and said lamp socket, said lamp connector also receiving AC with an abnormal voltage supplied through said bypass and said lamp socket;

a power processing circuit installed in said accommodating space of said lamp main body, said power processing circuit connected with said lamp main body, said power processing circuit receiving AC with a normal voltage or an abnormal voltage supplied by said lamp connector, said power processing circuit synchronously rectifying AC with a normal voltage or an abnormal voltage DC with a normal voltage or an abnormal-voltage;

a detecting switch disposed in said accommodating space of said lamp main body, said detecting switch connected with said power processing circuit, said detecting switch functioning to detect DC supplied by said power processing circuit, said detecting switch transmitting outward a normal signal and forming an open circuit when said detecting switch detects DC to have a normal voltage or an abnormal voltage, said detecting switch transmitting outward a blackout signal and becoming turned on when said detecting switch detects the voltage value of DC to be zero;

a charging circuit set in said accommodating space of said lamp main body, said charging circuit connected with said power processing circuit, said charging circuit receiving DC supplied by said power processing circuit, said charging circuit supplying DC needed for charging;

a charging battery assembled in said accommodating space of said lamp main body, said charging battery connected with said charging circuit, said charging battery receiving DC supplied by said charging circuit to carry out charging, said charging battery also connected with said detecting switch, said charging battery supplied with DC through said detecting switch when said detecting switch is turned on;

a driving circuit positioned in said accommodating space of said lamp main body, said driving circuit connected with said power processing circuit and said detecting switch so that said driving circuit may receive DC with a normal voltage or an abnormal voltage supplied by said power processing circuit or supplied by said charging battery through said detecting switch;

a micro-processor connected with said charging circuit and said charging battery as well as said detecting switch, said micro-processor commanding said charging circuit to charge said charging battery when said micro-processor receives a normal signal transmitted by said detecting switch, said micro-processor commanding said charging battery to supply said driving circuit with DC through said detecting switch when said micro-processor receives a blackout signal transmitted by said detecting switch; and a lamplight source located in said accommodating space of said lamp main boy, said lamplight source connected with said driving circuit, said lamplight source started to produce lighting when said lamplight source receives DC with a normal voltage supplied by said power processing circuit through said driving circuit, said lamplight source started automatically to produce lighting when said lamplight source receives DC supplied by said charging battery through said detecting switch and said driving circuit, said lamplight source turned off to extinguish lighting when said lamplight source receives DC with an abnormal voltage supplied by said power processing circuit through said driving circuit.

2. The intellectual lamp bulb unit installed on a conventional lamp socket controlled by a wall switch as claimed in claim 1, wherein said lamplight source is composed of at least one LED lamp.

3. The intellectual lamp unit installed on a conventional lamp socket controlled by a wall switch as claimed in claim 1, wherein when said wall switch is turned OFF, said lamp socket will receive AC with a reduced voltage.

4. The intellectual lamp bulb unit installed on a conventional lamp socket controlled by a wall switch as claimed in claim 1, wherein when said wall switch is turned OFF, said lamp socket will receive AC with a phase difference.

5. The intellectual lamp bulb unit installed on a conventional lamp socket controlled by a wall switch as claimed in claim 1, wherein said electronic element is a resistance for cutting down voltage.

6. The intellectual lamp bulb unit installed on a conventional lamp socket controlled by a wall switch as claimed in claim 1, wherein said electronic element is a diode for producing phase difference.

7. The intellectual lamp bulb unit installed on a conventional lamp socket controlled by a wall switch as claimed in claim 1, wherein said micro-processor is connected with a human body detector and a warning indicator.

8. The intellectual lamp bulb unit installed on a conventional lamp socket controlled by a wall switch as claimed in claim 1, wherein said microprocessor is connected with an earthquake detector and a warning indicator.

9. The intellectual lamp bulb unit installed on a conventional lamp socket controlled by a wall switch as claimed in claim 1, wherein said microprocessor is connected with a fire detector and a warning indicator.

10. The intellectual lamp bulb unit installed on a conventional lamp socket controlled by a wall switch as claimed in claim 1, wherein said microprocessor is connected with a human body detector, an earthquake detector, a fire detector and a warning indicator.

* * * * *